United States Patent [19]

Maier et al.

[11] 4,302,740

[45] Nov. 24, 1981

[54] CIRCUIT BREAKER MECHANISM

[75] Inventors: Alfred E. Maier; Louis N. Ricci, both of Chippewa Township, Allegheny County; Charles E. Haugh, Daughtry, all of Pa.

[73] Assignee: Westinghouse Electric Corp., Pittsburgh, Pa.

[21] Appl. No.: 102,047

[22] Filed: Dec. 10, 1979

[51] Int. Cl.[3] ..... H01H 73/02; H01H 75/00; H01H 77/00

[52] U.S. Cl. ..... 335/21; 335/167; 335/169

[58] Field of Search ..... 335/21, 167, 168, 169, 335/170, 171, 172, 253, 38

[56] References Cited

U.S. PATENT DOCUMENTS 3,774,129 11/1973 Sugiyama ..... 335/167

*Primary Examiner*—Harold Broome

*Attorney, Agent, or Firm*—L. P. Johns

[57] ABSTRACT

A circuit interrupter mechanism comprising an over-center toggle linkage and a releasable toggle latch means for latching the linkage in a partially closed position.

5 Claims, 3 Drawing Figures

CIRCUIT BREAKER MECHANISM

CROSS-REFERENCE TO RELATED APPLICATION

This application is related to the copending application of Walter V. Bratkowski, John A. Wafer, and James P. Ellsworth, Ser. No. 135,551, filed Mar. 31, 1980.

BACKGROUND OF THE INVENTION

1. Field of the Invention

This invention relates to a circuit breaker having a contact releasably latched in a partially closed position.

2. Description of the Prior Art

Circuit breakers of the type generally involved herein comprise a pair of separable contacts, an overcenter toggle mechanism for opening and closing the contacts, and a current responsive tripping mechanism for releasably latching the overcenter toggle mechanism. The tripping mechanism functions magnetically or thermally to release the overcenter toggle mechanism after a predetermined current overload or interval of time is involved. Such circuit breakers are disclosed in U.S. Pat. Nos. 3,480,900; 3,492,614; and 3,559,156.

Some circuit interrupters of prior construction have been unsatisfactory because of their relatively slow closing mechanism. For example, circuit interrupters having a gear type motor drive have been too slow for closing the contacts by a factor of 5 to 10 times. However, the use of solenoids for the main energy required too much current.

SUMMARY OF THE INVENTION

In accordance with this invention, a circuit interrupter is provided which comprises a relatively movable contact structure and contact arm for moving contacts between open and closed positions, operating means including an overcenter toggle and releasable arm operable to effect movement of the movable contact structure, lever means operatively connected to the overcenter toggle for moving the operating means between open and closed positions, the releasable arm being movable from a latched position to effect opening of the contacts, latch means for releasably holding the releasable arm in the latched position, the overcenter toggle comprising first link pivotally connected to the contact arm and a second link pivotally connected to the releasable arm, a knee pivot pivotally connecting the first and second links, toggle latch means for latching the overcenter toggle in the open position of the contacts in a partially closed position of the contacts, means for releasing the toggle latch means to effect closing of the contacts, handle latch means for holding a lever means in the open position and biased in the latched position, and means for releasing the handle latch means.

The advantage of the circuit breaker mechanism of this invention is that it holds the contact closing mechanism in a partially closed position to enable faster closing of the contacts when necessary.

DESCRIPTION OF THE PREFERRED EMBODIMENT

Figure 1:
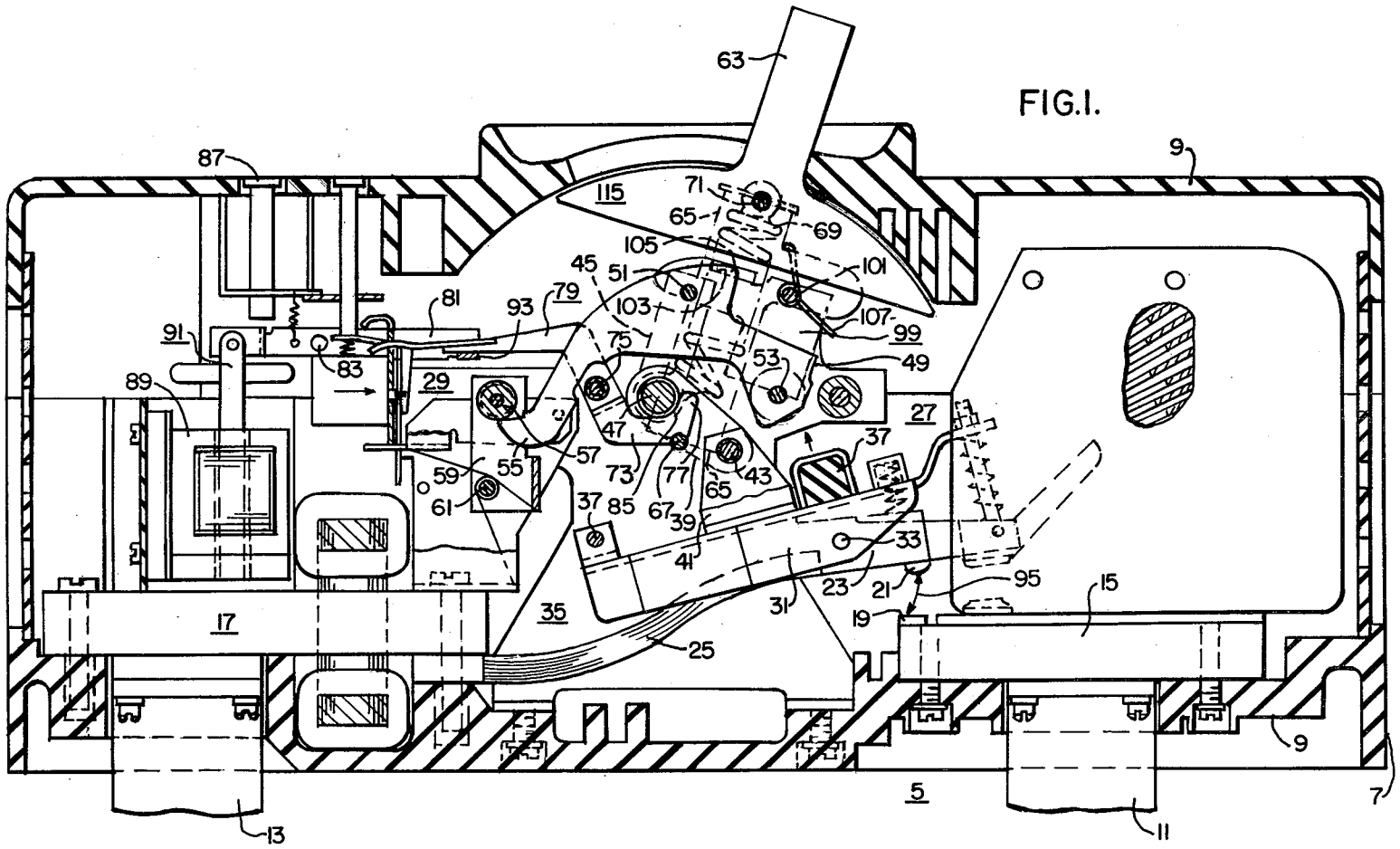
FIG. 1 is a vertical sectional view with parts broken away, showing a circuit breaker in a charged partially closed position, in accordance with this invention.

A circuit breaker, generally indicated at 5 in FIG. 1, corresponds to that disclosed in U.S. Pat. No. 3,826,951 which is incorporated by reference for which reason the description herein is limited to only the primary operating parts.

Figure 3:
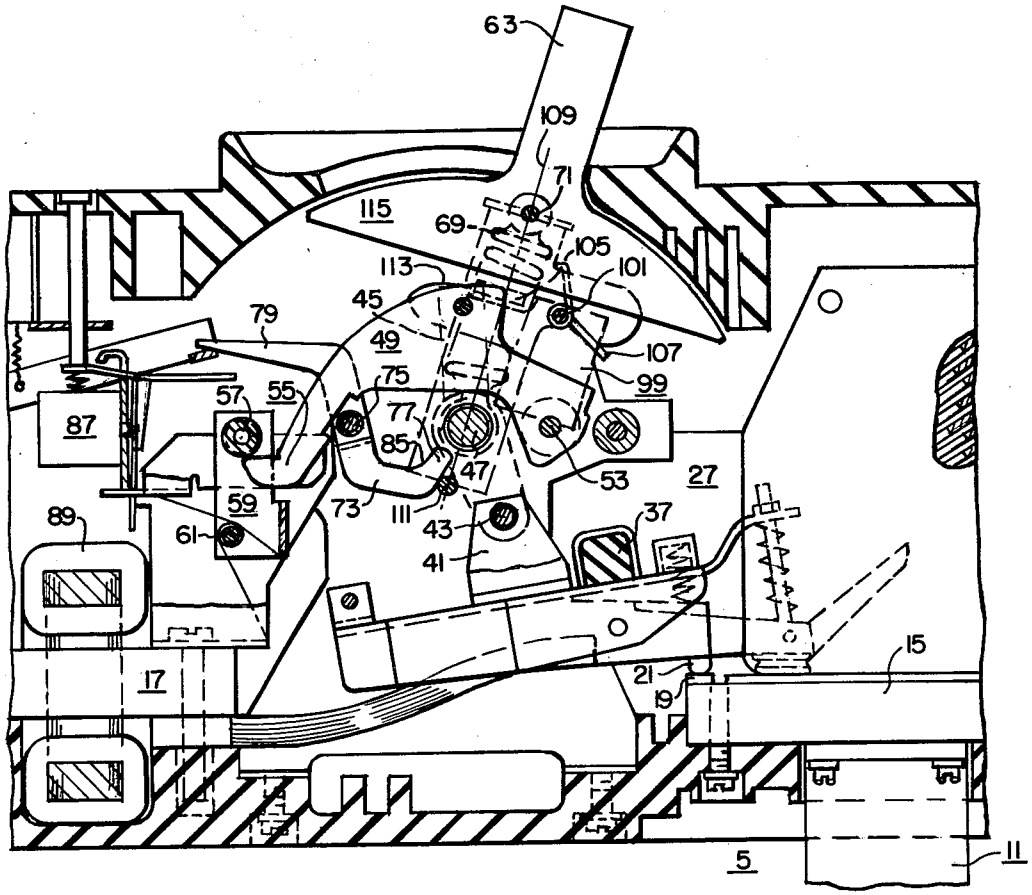
FIG. 3 is a fragmentary sectional view of the circuit breaker in the discharged fully closed position.

The circuit breaker 5 comprises an insulating housing including a molded insulating base 7 with a detachable cover 9 which housing is separated by suitable insulating barrier means into three adjacent insulating compartments for housing three-pole units of multi-pole circuit breakers in a manner known in the art. In each pole unit a pair of solderless terminals 11, 13 are provided at opposite ends of the associated compartment to enable connection of the circuit breaker to an electric circuit. Each of the three-pole compartments of the circuit breaker 5 include a circuit breaker unit comprising a pair of spaced conductors 15, 17, a stationary contact 19 on the conductor 15, a movable contact 21 on a contact arm 23, and a flexible conductor 25 between the contact arm 23 and the conductor 17. Accordingly, a circuit passing through the circuit breaker 5 extends from the terminal 11 through the elements 15, 19, 23, 25, 17 to the terminal 13. Although the contact arm 23 is shown in the open position, the closed position is shown in FIG. 3 with the contacts 19, 21 in the closed circuit position.

Each circuit breaker unit comprises an operating mechanism 27 and a latch and trip device 29. The operating mechanism 27 for each pole unit comprises the movable contact 21 which is welded or brazed on the contact arm 23 that is pivotally mounted on a switch arm 31 by a pivot pin 33. Each of the arms 31 is pivotally supported at one end thereof on a support bracket 35 by a pivot pin 37. The switch arms 31 of all three of the pole units are connected to move in unison by a common insulating tie bar 37 that is rigidly connected to all three of the switch arms.

Figure 2:
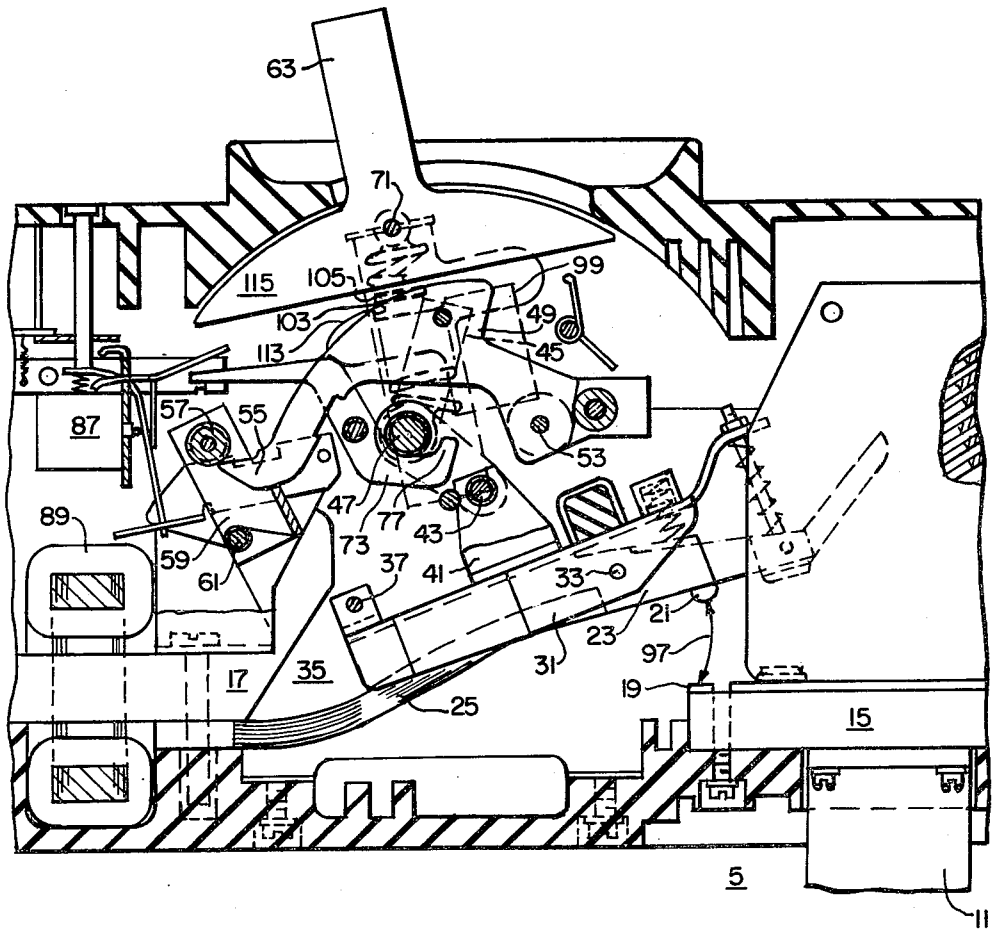
FIG. 2 is a fragmentary view of the circuit breaker in the discharged fully open position.

The switch arms 31 are actuated to the open and closed positions by the operating mechanism 27 which comprises a toggle link 39 pivotally connected to an extension 41 of the center pole switch arm 31 by a pivot pin 43. Another toggle link 45 is pivotally connected to the link 39 by a knee pivot pin 47. The assembly of the links 39, 45 and the pin 47 comprises an over center toggle linkage. The upper end of the toggle link 45 is pivotally connected to a cradle or releasable member 49 by a pivot pin 51. The releasable member 49 is pivotally supported at one end thereof on the support bracket 35 by a pivot pin 53. The other end 55 of the releasable member 49 is retained in a latched position by a roller 57 of the latch and trip device 29. Thus when abnormal current conditions occur, such as a current overload, through the conductors 15, 17, the latch and trip device 29 is actuated to cause a lever 59 to rotate counterclockwise about a pivot pin 61 to move the roller 57 to the left and thereby enable the releasable member 49 to rotate clockwise about the pivot pin 53. In addition, the operating mechanism 27 includes a handle 63 which is mounted on a U-shaped bracket 65 the lower end of which is pivoted on a pin 67, whereby the handle is rotatable between the closed position (FIGS. 1 and 3)

and the tripped (or open) position (FIG. 2). A pair of toggle springs 69 (one of which is shown) extends between a pivot pin 71 in the handle and the knee pivot pin 47 in a conventional manner.

In accordance with this invention, it has been found that the circuit interrupter 5, which comprises the over center toggle linkage, may be latched in the partially open position (FIG. 1) by providing a latch lever 73 which is pivotally mounted at 75 between a pair of support brackets 45. The lever 73 comprises an upturned end portion 77 which engages the knee pivot pin 47. The lever 73 also comprises a left end portion 79 which is operatively connected to a lever 81 which is pivoted at 83. When the lever is in the open-charged position (FIG. 1), the knee pivot pin 47 is disposed against an inclined surface 85 of the lever 73 to close the contacts 19, 21. The closing lever 81 is rotated counterclockwise about the pivot pin 83 by either pressing a manual button 87, or by remote means, such as a solenoid 89, having a plunger 91 attached to the left end of the lever 81. When the closing lever 81 having a flange 93 under the left end portion 79 is rotated counterclockwise, the latch lever 73 starts to rotate clockwise which rotation is enhanced by the pressure of the pin 47 against the surface 85. The charged toggle spring 69 moves the pin 47 to the right and thereby closes the contacts 19, 21. The time for closing the contacts is less because the distance between the open contacts 19, 21, as indicated by the arrow 95 (FIG. 1), is less than the distance indicated by the arrow 97 (FIG. 2) where the contacts 19, 21 are fully open as in prior constructions.

In addition to closing the contacts 19, 21 when the knee pivot pin 47 is released, the pin also strikes a latch handle lever 99 which is pivoted at 101 on the support bracket 35. The lever 99 is a bell crank having a notch 103 for engaging a tab 105 extending from one side of the operating lever 65. A wire spring 107 urges the lever 99 in the clockwise direction.

As shown in FIG. 3 when the pin 47 strikes the lever 99, the center of the pin has passed to the right side of a line 109 extending through the pivot pin 71 and a pivot pin 111 on which the operating lever 65 is pivoted. Accordingly, the lever 99 is rotated by the pin 47 to the position shown in FIG. 3 and the notch 103 is thereby lowered from the tab 105 so that the contacts 19, 21 can be opened by rotation of the handle 63 to the open position (FIG. 2).

When the contacts are opened, the pin 47 returns to the position, whereby releasing the lever 99 so that the spring 107 returns the lever to the latched position. Subsequently, when the handle 63 is moved from the open-discharged position (FIG. 2) to the open-charged position (FIG. 1), the tab 105 strikes an inclined surface 113 and moves again into the notch 103.

Moreover, when the handle 63 is moved from the closed position (FIG. 1) to the open position, a handle structure 115 strikes the right end of the closing lever 81 to return it and the latched lever 73 to the original position shown in FIG. 1. As a result when the handle 63 is returned to the position shown in FIG. 1, the knee pivot pin 47 is again retained by the lever 73 in the partially closed position (FIG. 1).

In conclusion, the device of this invention provides a standard molded circuit breaker mechanism having additional cooperating levers for closing the circuit breaker contacts in five cycles or less of AC current.

What is claimed is:

1. A circuit interrupter comprising relatively movable contact structure and contact arm for moving the contacts between open and closed positions, operating means including an overcenter toggle and releasable arm operable to effect movement of the movable contact structure, lever means operatively connected to the overcenter toggle for moving the operating means between open and closed positions, the releasable arm being movable from a latched position to effect opening of the contacts, latch means for releasably holding the releasable arm in the latched position, the overcenter toggle comprising first link pivotally connected to the contact arm and a second link pivotally connected to the releasable arm, a knee pivot pivotally connecting the first and second links, toggle latch means proximate to the knee pivot for latching the overcenter toggle in a partially closed position of the contacts, means connected to the toggle latch means for releasing the toggle latch means to effect closing of the contacts, handle latch means adjacent to the lever means for holding the lever means in the closed position, and means couple with the toggle latch means for releasing the handle latch means.

2. The circuit interrupter of claim 1 in which the toggle latch means holds the overcenter toggle in a partially closed position of the contacts.

3. The circuit interrupter of claim 2 in which the toggle latch means is a lever, and the means for releasing the toggle latch means comprising an electromagnetic actuator.

4. The circuit interrupter of claim 3 in which the handle latch means for holding the lever means is biased in the latched position.

5. The circuit interrupter of claim 4 in which the handle latch means is a lever having a portion in the path of movement of the knee pivot when said pivot moves to the contact closed portion to effect unlatching of the lever means.

* * * * *